US006997196B2

(12) United States Patent
Eiermann

(10) Patent No.: US 6,997,196 B2
(45) Date of Patent: Feb. 14, 2006

(54) DISHWASHER FOR RECEIVING ARTICLES DISPOSED IN A WASHING RECEPTACLE FOR CLEANING

(75) Inventor: Rüdiger Eiermann, Syrgenstein (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 10/879,793

(22) Filed: Jun. 28, 2004

(65) Prior Publication Data

US 2004/0261824 A1 Dec. 30, 2004

Related U.S. Application Data

(63) Continuation of application No. PCT/EP02/13314, filed on Nov. 26, 2002.

(30) Foreign Application Priority Data

Dec. 28, 2001 (DE) ..... 101 64 503

(51) Int. Cl.
*B08B 3/02* (2006.01)

(52) U.S. Cl. ..... 134/105; 134/108; 134/176; 134/179

(58) Field of Classification Search ..... 134/105, 134/108, 57 D, 58 D, 107, 176, 179
See application file for complete search history.

(56) References Cited

U.S. PATENT DOCUMENTS 1,755,101 A * 4/1930 Fording et al. ..... 34/187
1,836,373 A * 12/1931 Kadesch ..... 134/56 D
2,260,518 A * 10/1941 Nicholson et al. ..... 134/110
2,277,291 A 3/1942 Blair
2,395,968 A * 3/1946 Hiort Af Ornas ..... 134/56 D
2,431,246 A * 11/1947 Hallanan ..... 68/207
2,585,608 A * 2/1952 Wieghart ..... 239/251
2,618,281 A * 11/1952 Hiort Af Ornas ..... 134/57 D
2,664,094 A * 12/1953 Spragins ..... 134/58 DL
2,951,490 A * 9/1960 Cuillier ..... 134/107
2,981,267 A * 4/1961 Stoddard ..... 134/95.3

(Continued)

FOREIGN PATENT DOCUMENTS

DE 483 793 9/1929

(Continued)

OTHER PUBLICATIONS

European Patent Office 291,713 Nov. 1988.*
European Patent Office 0 291 713 Apr. 1998.*
European Patent Office 1 082 938 Apr. 2000.*
WIPO WO 97/20493 Jun. 1997.*

*Primary Examiner*—Frankie L. Stinson
(74) *Attorney, Agent, or Firm*—John T. Winburn; Russel W. Warnock; Craig J. Loest

(57) ABSTRACT

A dishwasher includes a washing receptacle for items to be cleaned, a pump for liquid, a flow heater for liquid, a device for spraying items to be cleaned, a control device for wash cycles of the spraying device, and a device for providing steam having a separate steam dispenser and unit for producing a jet of steam supplied by the steam dispenser. The steam dispenser and the steam jet unit are disposed in the dishwasher in such a way that the steam jet unit always supplies steam to the same predetermined location in the washing receptacle specifically identified and configured for receiving particular items to be cleaned, e.g. particularly dirty items. An uncontrolled escape of steam from any section of the entire washing receptacle is prevented, thus improving the cleaning result with maximum usage of the steam and without also being dependent on activation of a separate steam washing cycle.

9 Claims, 3 Drawing Sheets

U.S. PATENT DOCUMENTS

| | | | | | |
|---|---|---|---|---|---|
| 3,049,136 | A | * | 8/1962 | Van Scoyk | 134/95.2 |
| 3,049,450 | A | * | 8/1962 | Koons et al. | 134/11 |
| 3,072,128 | A | * | 1/1963 | James | 134/57 D |
| 3,160,170 | A | * | 12/1964 | Sampsel | 137/341 |
| 3,586,011 | A | * | 6/1971 | Mazza | 134/57 D |
| 3,717,159 | A | * | 2/1973 | Caviccioli | 134/58 DL |
| 3,890,987 | A | | 6/1975 | Marcussen et al. | |
| 4,135,531 | A | * | 1/1979 | Federighi et al. | 134/95.3 |
| 4,235,642 | A | * | 11/1980 | Federighi et al. | 134/58 D |
| 4,279,384 | A | * | 7/1981 | Yamamoto | 239/67 |
| 4,366,005 | A | * | 12/1982 | Oguri et al. | 134/25.2 |
| 4,457,323 | A | * | 7/1984 | Fay et al. | 134/18 |
| 6,422,180 | B1 | * | 7/2002 | Yiu | 122/404 |
| 2002/0078977 | A1 | * | 6/2002 | Manne | 134/25.2 |
| 2004/0040586 | A1 | * | 3/2004 | Kumar | 134/26 |

FOREIGN PATENT DOCUMENTS

| | | | | |
|---|---|---|---|---|
| DE | 29 00 954 | A1 | | 7/1979 |
| DE | 40 34 380 | | * | 4/1992 |
| DE | 42 33 934 | | * | 4/1994 |
| DE | 44 01 420 | A1 | | 7/1995 |
| DE | 196 27 044 | | * | 1/1998 |
| EP | 0 299 343 | A1 | | 1/1989 |
| EP | 0 365 500 | A1 | | 4/1990 |
| JP | 2-82930 | | * | 3/1990 |
| JP | 4-246321 | | * | 9/1992 |
| JP | 10-262893 | | * | 10/1998 |
| JP | 11-206681 | | * | 8/1999 |
| JP | 2001-275917 | | * | 10/2001 |

* cited by examiner

DISHWASHER FOR RECEIVING ARTICLES DISPOSED IN A WASHING RECEPTACLE FOR CLEANING

CROSS-REFERENCE TO RELATED APPLICATION

This application is a continuation, under 35 U.S.C. §120, of copending International Application No. PCT/EP02/13314, filed Nov. 26, 2002, which designated the United States; this application also claims the priority, under 35 U.S.C. §119, of German Patent Application 101 64 503.1, filed Dec. 28, 2001; the prior applications are herewith incorporated by reference in their entirety.

BACKGROUND OF THE INVENTION

1. Field of the Invention

The present invention relates to a dishwasher having a washing receptacle for receiving items to be cleaned, a pump for circulating liquid, a flow heater for heating the liquid, a spraying device for applying the liquid to the items to be cleaned by selection of a wash cycle through a control device, and a device for providing steam.

German Published, Non-Prosecuted Patent Application 29 00 954, corresponding to U.S. Pat. No. 4,366,005, discloses a dishwasher having a washing receptacle for receiving items to be cleaned, a pump for circulating liquid, a flow heater for heating the liquid and a spraying device for applying the liquid to the items to be cleaned by selection of a wash cycle through a control device. In addition, the dishwasher has a device for providing steam by activation of a separate steam cycle running between a pre-rinse cycle and a main wash cycle. The device for providing steam is disposed directly under the spraying device in the washing receptacle itself and delivers the steam escaping in an uncontrolled manner from steam outlet openings into the washing receptacle at any point by heating up water in a separate chamber. At the same time, the steam cycle serves to prepare heavily soiled items to be cleaned and is initiated by selection of a corresponding program by the user through the control device. In order to decalcify the steam generator, the device responsible for providing the steam must be removed from the dishwasher and cleaned manually.

German Published, Non-Prosecuted Patent Application DE 44 01 420 A1 discloses a working container for a dishwasher, which has a heating element with a steam chamber partially filled with vaporizable liquid.

SUMMARY OF THE INVENTION

It is accordingly an object of the invention to provide a dishwasher for receiving articles disposed in a washing receptacle for cleaning, which overcomes the hereinafore-mentioned disadvantages of the heretofore-known devices of this general type and in which the cleaning result for particularly heavily soiled items to be cleaned with the aid of steam, is improved.

With the foregoing and other objects in view there is provided, in accordance with the invention, a dishwasher, comprising a washing receptacle for receiving items to be cleaned, a pump for circulating liquid, a flow heater for heating the liquid, a spraying device for applying the liquid to the items to be cleaned, a control device for selecting wash cycles for applying the liquid with the spraying device to the items to be cleaned, and a device for providing steam having a steam dispenser and a unit for producing a jet of steam supplied by the steam dispenser. The steam dispenser and the unit are disposed in the dishwasher in such a way that the unit for producing a jet of steam supplies steam to a predetermined location in the washing receptacle for receiving particular items to be cleaned.

The structure according to the invention advantageously results in a configuration of the device provided for providing steam having the steam dispenser and the unit for producing a jet of steam separated from one another, in such a way that the same specific location in the washing receptacle, which can be particularly characterized and configured for receiving the particular, e.g. heavily-soiled, items to be cleaned, is always supplied with steam by the unit for producing a jet of steam. An uncontrolled escape of steam at any location into the entire washing receptacle is avoided according to the invention, resulting in an improvement of the cleaning result with the greatest possible use of the steam and additionally not depending on activation of a separate steam wash cycle.

In accordance with another feature of the invention, the predetermined location provided for receiving particular items to be cleaned is disposed in the vicinity of a washing receptacle wall. This allows the cleaning result to be further optimized, because the only exit point for the steam for supplying the particular items to be cleaned is in the boundary region of the washing receptacle and is not tangent to the other normal items to be cleaned.

In accordance with a further feature of the invention, the steam dispenser is disposed parallel to the flow heater and is supplied by an intermediate valve with liquid from the selected wash cycle. In this way the steam dispenser is located in the hydraulic circuit of the dishwasher, providing the possibility of automatically filling the steam dispenser with liquid a number of times throughout a wash cycle and vaporizing the latter. A separate steam cycle is not required.

In accordance with an added feature of the invention, the unit for producing a jet of steam is provided with a combined steam jet nozzle, which has an outlet opening for a liquid jet and another outlet opening for the steam. In this way the deposits occurring in the steam generator and/or the unit for producing a jet of steam and/or the nozzle, especially lime particles forming during heating of the liquid or vaporizing, can be rinsed out, without one of the above-mentioned devices having to be exchanged manually for this purpose as an extra exercise.

In accordance with an additional feature of the invention, the steam jet nozzle has a two-way valve, which closes one outlet opening and opens the other outlet opening. One and the same valve on one hand selects the path for dispensing liquid and on the other hand selects the path for escape of the steam. Preferably, the steam jet nozzle has the outlet opening for the steam directed upwards and the outlet opening for the liquid jet directed to the side. According to an alternative configuration of the invention having a steam jet nozzle, the outlet opening for the steam and the outlet opening for the liquid jet can also be aligned parallel.

In accordance with yet another feature of the invention, the two-way valve has a double ball float which, when the steam dispenser is switched on, closes the outlet opening for the liquid jet using its upper spherical end and, when the steam dispenser switched off and liquid is conveyed from below, moves upwards due to its lower spherical end while its upper spherical end closes the outlet opening for the steam and opens the outlet opening for the liquid jet.

In accordance with yet a further feature of the invention, in an alternative construction, the two-way valve has a spoon ball configuration having a spoon-shaped end and a spherical end, the spoon-shaped end of the two-way valve closing the outlet opening for the liquid jet when the steam dispenser is switched on, and the spherical end of the two-way valve moving upwards when the steam dispenser is switched off and liquid is conveyed from below to close the outlet opening for steam and cause the spoon-shaped end to open the outlet opening for the liquid jet.

In accordance with yet an added feature of the invention, liquid is dispensed through the outlet opening for the liquid jet of the steam jet nozzle onto a sieve or screen disposed in the washing receptacle for cleaning the sieve or screen. Thus the nozzle can be employed not only for the escape of steam at the predetermined location for cleaning purposes for particular items to be cleaned, but also at another location in the washing receptacle for cleaning purposes for other devices, preferably for the sieve or screen which is frequently heavily contaminated with solid particles. This is otherwise possible only in a separate cleaning procedure performed by the user in most cases manually, and not automatically.

In accordance with yet a concomitant feature of the invention, a clear liquid for removing deposits is fed through the switched-off steam dispenser, the unit for producing a jet of steam and the steam jet nozzle. The result of flushing residue including lime particles in the above-mentioned devices is again improved by using a clear washing liquid.

Other features which are considered as characteristic for the invention are set forth in the appended claims.

Although the invention is illustrated and described herein as embodied in a dishwasher for receiving articles disposed in a washing receptacle for cleaning, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
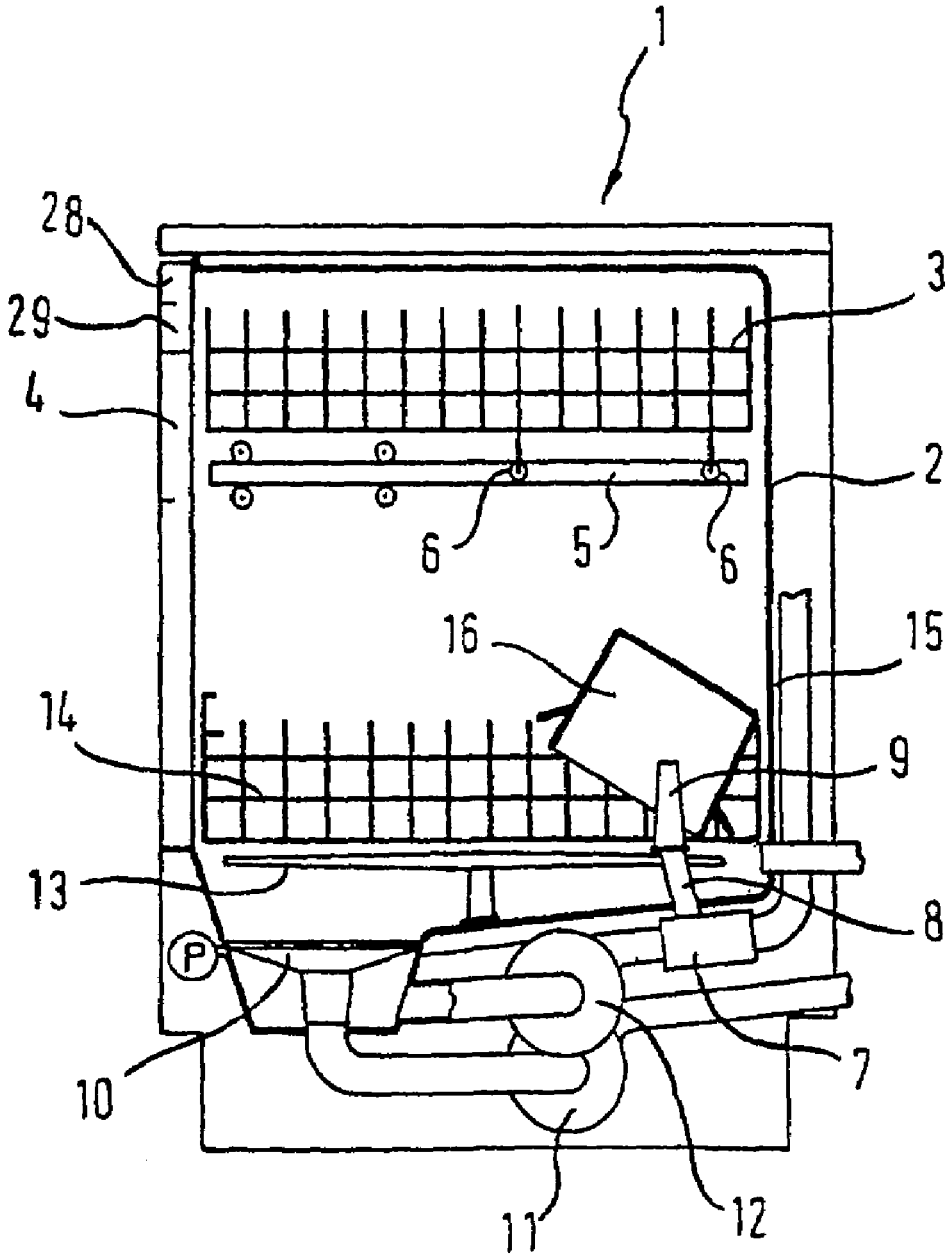
FIG. 1 is a diagrammatic, side-elevational view of the inside of a washing receptacle of a dishwasher according to the invention.

Referring now to the figures of the drawings in detail and first, particularly, to FIG. 1 thereof, there is seen an elevational view of the inside of a washing receptacle or compartment 2 of a dishwasher 1 according to the invention, in which an upper dish rack 3 and a lower dish rack 14 for receiving items to be cleaned, e.g. dishes and cutlery items, are disposed. The dish racks 3, 14 in each case include rack side walls and a rack floor with vertical and horizontal rack struts and usually have parallel spokes directed obliquely upwards, between which particularly flat crockery items such as plates, saucers. etc. can be held firmly in place in the washing receptacle 2. The upper dish rack 3 is constructed to be retracted from the washing receptacle 2 through the use of several track rollers 6, which move on rack guide rails 5 disposed near the washing receptacle side walls. The rack can be withdrawn only upon opening a door 4, which is attached frontally for closing and opening the dishwasher 1. In the upper region, the door has an operating panel 28 with display elements 28' and program selection switches 29 for activating different programs such as e.g. washing and drying cycles, as is seen in FIGS. 1 and 2.

The dishwasher 1 in addition has spraying devices. One spraying device 13 thereof is disposed in the form of a spray arm under the lower dish rack 14 in the washing receptacle 2, for applying liquid, usually water, to the items to be cleaned by selecting a wash cycle through a control device 30 connected to the program selection switches 29. A pump, which is not visible herein in side elevation, circulates the liquid, before it is fed to a flow heater, which is likewise not visible herein in side elevation, inter alia, for heating the liquid and then the spraying device 13. This hydraulic circuit also includes several supply lines and discharge lines 11, 12 for feeding the washing liquid to the items to be cleaned, as well as for its return follow the wash cycle. One discharge line 11 is connected to a sieve or screen 10 disposed in the washing receptacle near a container floor for collecting solid pieces and particles. Disposed in another supply line 12 of the hydraulic circuit for conveying liquid is a steam dispenser 7, advantageously parallel to the flow heater, which supplies a unit 8 for producing a jet of steam with an attached steam jet nozzle 9 for providing steam. The steam dispenser 7 and the unit 8 for producing a jet of steam jointly form a device for providing steam and are incorporated in the dishwasher 1 in such a way that a predetermined location, provided for receiving particular items 16 to be cleaned (a heavily soiled pot stacked in the lower dish rack 14 in the selected example), is fed with steam by the unit 8 for producing a jet of steam in the washing receptacle 2. According to the illustrated embodiment, the sole and predetermined location provided for receiving the particular items 16 to be cleaned is preferably installed in the region of a washing receptacle wall, in this example a rear wall 15 of the washing receptacle. The cleaning result can be further optimized thereby, because the sole exit point for the steam for supplying the pot 16 is in the limit region of the washing receptacle 2, and not tangent to the other "normal" items to be cleaned, that are stacked in another area of the lower dish rack 14.

The object of the invention advantageously results in a configuration of the device provided for providing steam, with the steam dispenser 7 and the unit 8 for producing a jet of steam separated from one another, in connection with the steam jet nozzle 9, in such a way that the same predetermined location in the washing receptacle 2, which can be particularly characterized and configured for receiving the particular items 16 to be cleaned, without the usual spikes, but with a separate stop mechanism in the lower dish rack 14, is always supplied with steam by the unit for producing a jet of steam. An uncontrolled escape of steam at any location into the entire washing receptacle is avoided by the invention, resulting in an improvement of the cleaning result with the greatest possible use of the steam and additionally not depending on activation of a separate steam wash cycle.

Figure 2:
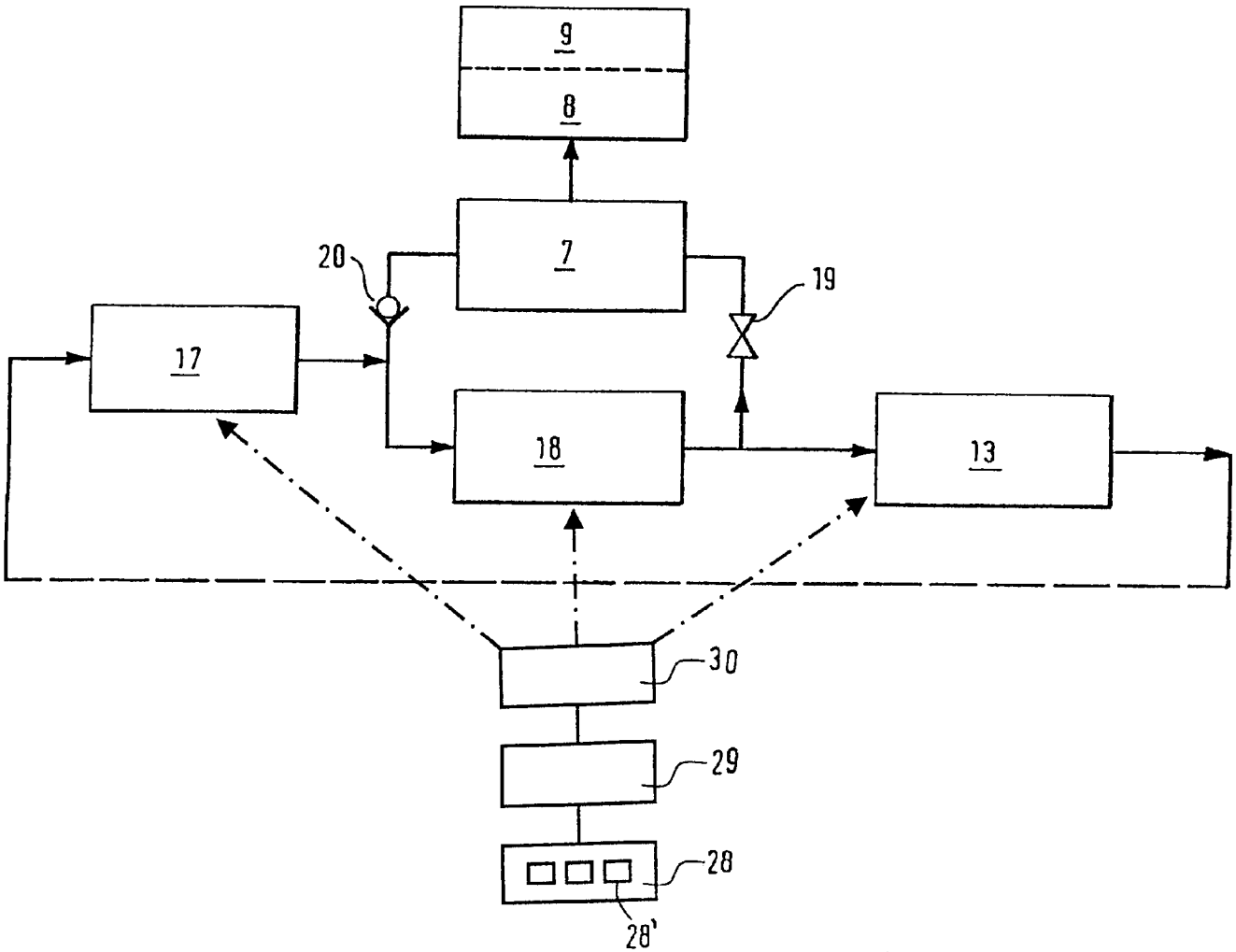
FIG. 2 is a block diagram of devices for providing steam in the dishwasher.

FIG. 2 shows a block diagram of the devices for providing steam in the dishwasher according to FIG. 1. The steam dispenser 7, preferably disposed parallel to a flow heater 18, and the unit 8 for producing a jet of steam supplied by the steam dispenser 7 and fitted with the steam jet nozzle 9, are located particularly favorably in the hydraulic circuit of the dishwasher. This offers the particular possibility of automatically filling the steam dispenser 7 several times during a wash cycle with liquid and vaporizing the latter. A separate steam cycle is not required, thus avoiding additional control and time expenditure. In the process, the liquid, preferably clear water, is conveyed by an upstream circulating pump 17, transported through the flow heater 18, both in a switched-off and in a switched-on state for heating the water, and forwarded to the spraying device 13 and in a parallel path through an inlet valve 19 to the steam dispenser 7. A return valve 20 is inserted at the outlet of the steam dispenser 7 for safety reasons, parallel to the valve 19 at the inlet of the steam dispenser 7. The hydraulic circuit is closed, as is indicated by dashed lines, by diverting the washing liquid into the water circuit after a wash cycle and supplying fresh liquid through the circulating pump 17. It is also noted that the steam dispenser 7, the unit 8 for producing a jet of steam and the steam jet nozzle 9 together form a device for providing steam. The unit 8 for producing a jet of steam may also include the steam jet nozzle 9 and therefore the term "unit" may include elements 8 and 9.

Figure 3:
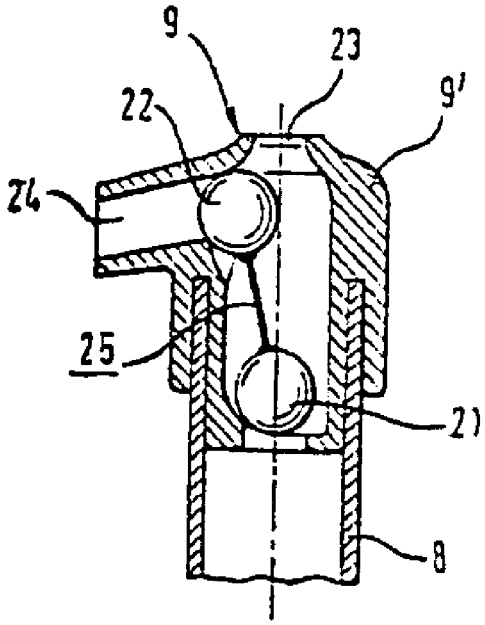
FIGS. 3 and 4 are respective fragmentary, lateral-sectional and elevational views of a steam jet nozzle of a unit for producing a jet of steam with a built-in two-way valve.
Figure 4:
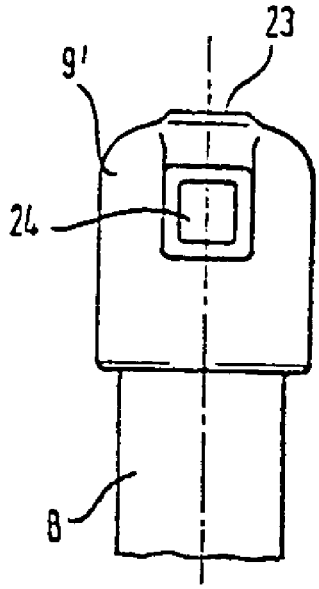

FIGS. 3 and 4 show the steam jet nozzle 9 with a built-in two-way valve 25 in a lateral-sectional view in FIG. 3 and in an elevational view in FIG. 4. The unit 8 for producing a jet of steam is fitted with the combined steam jet nozzle 9, which has an outlet opening 24 for a liquid jet and another outlet opening 23 for the steam. The deposits inevitably accumulating over time in a steam generator and/or the unit for producing a jet of steam and/or the nozzle, especially lime particles forming during heating of the liquid or vaporizing, can be rinsed out with water, for example, due to the dispensing and steam paths being separated from one another, without any of the above-mentioned devices having to be exchanged manually for this purpose as an extra step. The result of flushing residue including the lime particles in the above-mentioned devices is again improved by using a clear washing liquid.

It has proven particularly beneficial if the steam jet nozzle 9 has a two-way valve, which closes one outlet opening 24 and at the same time opens or leaves open the other outlet opening 23. One and the same valve 25 on one hand selects the path for dispensing liquid and on the other hand automatically selects the path for escape of the steam. Through the use of the steam jet nozzle 9, preferably the outlet opening 23 for the steam is directed upwards and the outlet opening 24 for the liquid jet is directed to the side. According to an alternative configuration of the invention, the steam jet nozzle 9 has the outlet opening for the steam and the outlet opening for the liquid jet aligned parallel, as is seen in the construction of a two-way valve 25' according to FIG. 5.

The two-way valve 25 of the nozzle 9 is configured particularly advantageously as a double ball float, in the manner of a dumbbell with two spheres attached at the ends. The double ball float closes the outlet opening 24 provided for the liquid jet using its upper spherical end 22 when the steam dispenser is switched on. The lower spherical end 21 of the double ball float moves or floats upwards in the direction of the other outlet opening 23 when the steam dispenser is switched off and liquid is conveyed from below and flows through the attached unit 8 for producing a jet of steam into the interior of the nozzle 9, and its upper spherical end closes the outlet opening 23 for the steam and opens the outlet opening 24 provided for the liquid jet, through which the water is flushed out to the side. The elevational view illustrated in FIG. 4 shows the connection of the unit 8 for producing a jet of steam to a housing 9' of the steam jet nozzle with the two outlet openings 23, 24 respectively directed upwards and to the side.

Figure 5:
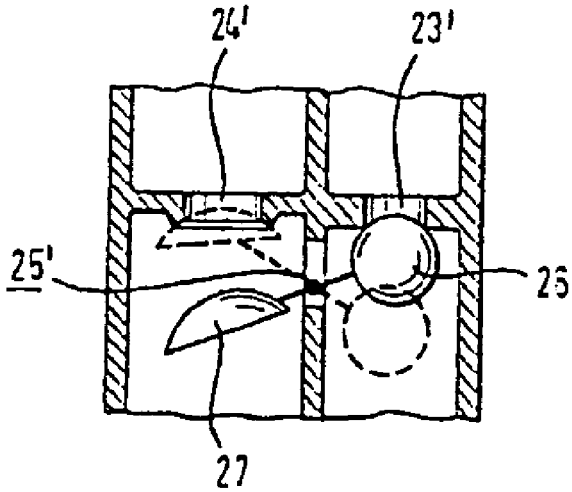
FIG. 5 is a fragmentary, sectional view of an alternative embodiment of the two-way valve.

In an alternative construction of the two-way valve 25' according to the sectional view of FIG. 5, the latter is configured as a spoon ball configuration, in the manner of scales, with a spoon at one end and a sphere at the other end. A spoon-shaped end 27 of the spoon ball configuration closes an outlet opening 24' provided for the liquid jet with the steam dispenser switched on. A spherical end 26 of the spoon ball configuration moves up in the direction of the other parallel opening 23', with the steam dispenser switched off, and liquid fed from below flows into the interior of the nozzle to close the outlet opening 23' provided for the steam while the spoon-shaped end opens the outlet opening 24' for the liquid jet.

According to another configuration of the invention which has proven to be of particular value, a liquid, at best clear water, is sprayed onto the sieve or screen 10 disposed in the washing receptacle as seen in FIG. 1, through the outlet opening 24, 24' of the steam jet nozzle 9 that in each case is provided for the escape of a liquid jet, for sieve cleaning. Thus the nozzle 9 can be employed not only for the escape of steam at the predetermined location for cleaning purposes for particular items to be cleaned, but also at another location in the washing receptacle for cleaning purposes for other devices, preferably for the screen which is frequently heavily contaminated with solid particles. This is otherwise possible only in a separate cleaning procedure performed by the user, in most cases manually, and not automatically.

I claim:

1. A dishwasher, comprising:

a washing receptacle for receiving items to be cleaned;

a pump for circulating liquid;

a flow heater associated with said pump for heating the liquid;

a spraying device associated with said flow heater for applying the liquid to the items to be cleaned;

a control device associated with said spraying device for selecting wash cycles for applying the liquid with said spraying device to the items to be cleaned; and a device associated with said flow heater for providing steam, said device having a steam dispenser connected in parallel with said flow heater, and said steam dispenser is being supplied with liquid through an intermediate valve in a selected wash cycle, and said device having a unit for producing a jet of steam supplied by said steam dispenser, said unit for producing a jet of steam supplying steam to a predetermined location in said washing receptacle for receiving particular items to be cleaned.

2. A dishwasher, comprising:

a washing receptacle for receiving items to be cleaned;

a pump for circulating liquid;

a flow heater associated with said pump for heating the liquid;

a spraying device associated with said flow heater for applying the liquid to the items to be cleaned;

a control device associated with said spraying device for selecting wash cycles for applying the liquid with said spraying device to the items to be cleaned; and a device associated with said flow heater for providing steam, said device having a steam dispenser and a unit for producing a jet of steam supplied by said steam dispenser, said unit for producing a jet of steam includes including a combined steam jet nozzle having an outlet opening for a liquid jet and an outlet opening for steam, and said unit for producing a jet of steam supplying steam to a predetermined location in said washing receptacle for receiving particular items to be cleaned.

3. The dishwasher according to claim 2, wherein said steam jet nozzle has a two-way valve closing one of said outlet openings and opening another of said outlet openings.

4. The dishwasher according to claim 3, wherein:

said two-way valve has a double ball float having upper and lower spherical ends;

said upper spherical end of said double ball float closing said outlet opening for the liquid jet when said steam dispenser is switched on; and said lower spherical end moving said double ball float upwards when said steam dispenser is switched off and liquid is conveyed from below to close said outlet opening for steam and cause said upper spherical end to open said outlet opening for the liquid jet.

5. The dishwasher according to claim 3, wherein:

said two-way valve has a spoon ball configuration having a spoon-shaped end and a spherical end;

said spoon-shaped end of said two-way valve closing said outlet opening for the liquid jet when the steam dispenser is switched on; and said spherical end of said two-way valve moving upwards when the steam dispenser is switched off and liquid is conveyed from below to close said outlet opening for steam and cause said spoon-shaped end to open said outlet opening for the liquid jet.

6. The dishwasher according to claim 2, wherein said outlet opening for steam is directed upwards and said outlet opening for the liquid jet is directed to the side.

7. The dishwasher according to claim 2, wherein said outlet opening for steam and said outlet opening for the liquid jet are aligned mutually parallel.

8. The dishwasher according to claim 2, which further comprises a sieve disposed in said washing receptacle, said outlet opening of said steam jet nozzle for a liquid jet spraying liquid onto said sieve for sieve cleaning.

9. The dishwasher according to claim 2, wherein said steam dispenser in a switched-off state, said unit for producing a jet of steam and said steam jet nozzle convey clear liquid for removing deposits.

* * * * *